US005513592A

United States Patent [19]

Cotton

[11] Patent Number: 5,513,592

[45] Date of Patent: May 7, 1996

[54] DEVICE FOR CONNECTING A FLOATING OBJECT TO A MOORAGE STRUCTURE

[75] Inventor: Oren L. Cotton, Eastsound, Wash.

[73] Assignee: Orcas Marine Products, Inc., Eastsound, Wash.

[21] Appl. No.: 490,356

[22] Filed: Jun. 14, 1995

Related U.S. Application Data

[63] Continuation-in-part of Ser. No. 315,953, Sep. 30, 1994, Pat. No. 5,425,324.

[51] Int. Cl.[6] ..... B63B 21/00

[52] U.S. Cl. ..... 114/219; 405/219

[58] Field of Search ..... 114/219, 230; 405/219; D8/349, 354

[56] References Cited

U.S. PATENT DOCUMENTS

| | | | |
|---|---|---|---|
| 212,143 | 2/1879 | Hulster . | |
| 799,645 | 9/1905 | Grimm . | |
| 973,906 | 10/1910 | Askegren | 114/251 |
| 1,094,610 | 4/1914 | Steinhauer | 114/230 |
| 1,145,749 | 7/1915 | Claud . | |
| 2,552,424 | 5/1951 | Gorman . | |
| 2,569,783 | 10/1951 | Smith . | |
| 2,662,501 | 12/1953 | Bascome, Jr. . | |
| 2,679,818 | 6/1954 | Herbert et al. | 114/230 |
| 2,912,953 | 11/1959 | Olsen | 114/230 |
| 2,930,339 | 3/1960 | Trnka | 114/230 |
| 2,938,492 | 5/1960 | Kulick . | |
| 2,996,033 | 8/1961 | Yordi . | |
| 3,084,517 | 4/1963 | Bell . | |
| 3,095,848 | 7/1963 | Dick . | |
| 3,120,831 | 2/1964 | Fulton . | |
| 3,157,150 | 11/1964 | Faber . | |
| 3,187,707 | 6/1965 | Carbone . | |
| 3,195,498 | 7/1965 | Johns . | |
| 3,196,824 | 7/1965 | Howard . | |
| 3,389,675 | 6/1968 | Kieft et al. | 114/230 |
| 4,040,377 | 8/1977 | Olsen | 114/230 |
| 4,250,827 | 2/1981 | Booker et al. | 114/230 |
| 4,356,783 | 11/1982 | Myklebust et al. | 114/230 |
| 4,686,926 | 8/1987 | Vance | 114/230 |
| 5,013,272 | 5/1991 | Watkins | 114/219 |
| 5,036,787 | 8/1991 | Rogers | 114/230 |
| 5,154,132 | 10/1992 | Brushaber | 114/230 |
| 5,361,716 | 11/1994 | Cotton | 114/230 |
| 5,425,324 | 6/1995 | Cotton | 114/230 |

*Primary Examiner*—Jesus D. Sotelo

*Attorney, Agent, or Firm*—Chernoff, Vilhauer, McClung & Stenzel

[57] ABSTRACT

A mooring device for connecting a floating object to a moorage structure includes an elongate resiliently yieldable member which has a longitudinally-extending, normally arcuate shape when in an unstressed state. The yieldable member is operatively connected between the floating object at a first end and the moorage structure at a second end. The yieldable member is yieldably bendable from the normally arcuate shape to a more arcuate shape in response to movement of the floating object toward the moorage structure so as to yieldably resist the movement. One exemplary non-portable embodiment include a base which connects the second end to the moorage structure. Another exemplary embodiment includes a removable resilient fender which is adapted to connect the first end to the floating object for portability. A third exemplary embodiment is adapted selectively either for portable or non-portable use.

10 Claims, 10 Drawing Sheets

DEVICE FOR CONNECTING A FLOATING OBJECT TO A MOORAGE STRUCTURE

This application is a continuation-in-part of application Ser. No. 08/315,953, filed Sep. 30, 1994, now U.S. Pat. No. 5,425,324.

BACKGROUND OF THE INVENTION

The present invention relates to a device for connecting a floating object to a moorage structure and particularly to a fiberglass mooring device for mooring a vessel to a dock, pier, or moorage float.

Floating objects such as boats, vessels, or platforms are traditionally moored alongside moorage structures such as docks, piers, or floats by use of mooring lines and resilient fenders. However, when a floating object is moored to a moorage structure using traditional devices, during severe or stormy conditions the floating object, the moorage structure, or both are generally subject to damage. Fenders placed between the floating object and the moorage structure as a buffer are easily dislodged or otherwise are insufficient to prevent damage. Further, where currents, storm waves, or wakes of passing vessels cause significant or prolonged relative movement, traditional fenders may rub the surfaces of the floating object and cause considerable damage to the paint or other surface finish.

Another problem with traditional devices for attaching floating objects to moorage structures is the necessity to adjust conventional mooring lines in response to tidal rise and fall of the water with respect to the moorage structure. No such adjustment is needed when the moorage structure is a float which is free to rise and fall on the tide. Even with floats, however, it is sometimes difficult to limit movement of a floating object to the extent desired without undesirably straining mooring lines when the floating object moves relative to the moorage structure in response to storm waves or wakes of passing vessels.

Mooring whips are one type of device used to connect a floating object to a moorage structure. These whips consist of a highly flexible straight rod or pole which is securely and permanently fastened to a moorage structure. Whips are an improvement over other devices in that they allow for adjustment in heights due to tides. However, because a mooring whip is essentially straight when it is not connected to the floating object, it must be highly flexible so that it can be bent manually to connect its free end to the floating object. This high degree of flexibility, however, often allows too much movement of the floating object which can then come in contact with the moorage structure and thereby cause damage under severe wave or wake conditions. Another problem with mooring whips is that they are generally permanently installed on moorage structures and are not portable to enable their use in connecting a floating object to alternate moorage structures having no permanently installed mooring whips.

What is needed, then, is a mooring device which, although resiliently yieldable, is much less flexible than a conventional mooring whip and is of simple, inexpensive construction, capable of quiet operation and adaptable to floating objects and/or moorage structures of differing configurations. The mooring device should be usable either in combination with or independent of conventional mooring lines to control movement of a floating object with respect to a moorage structure with sufficient resilient resistance to prevent contact between the moorage structure and the floating object under severe conditions. Preferably, the mooring device should also be portable and attachable to alternative moorage structure.

SUMMARY OF THE INVENTION

A mooring device according to the present invention includes an elongate resiliently yieldable member which has a longitudinally-extending, normally arcuate shape when in an unstressed state. The yieldable member is operatively connected between the floating object at a first end and the moorage structure at a second end, and is yieldably bendable from the normally arcuate shape to a more arcuate shape in response to movement of the floating object toward the moorage structure so as to yieldably resist the movement.

According to one aspect of the invention, the interconnection of the mooring device with the floating object and/or the moorage structure is easily attachable and detachable without requiring any connecting hardware protruding significantly from the attachment surface of the floating object and/or the moorage structure.

According to another aspect of the invention, such interconnection is highly versatile to accommodate attachment surfaces of different orientations and heights.

According to another aspect of the invention, such interconnection isolates the attachment surface from torques imposed about both horizontal and vertical axes.

According to another aspect of the invention, such interconnection also automatically attaches and detaches spring lines.

According to another aspect of the invention, the mooring device may be easily and removably transported on a floating object to be used in connecting to alternative moorage structures.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
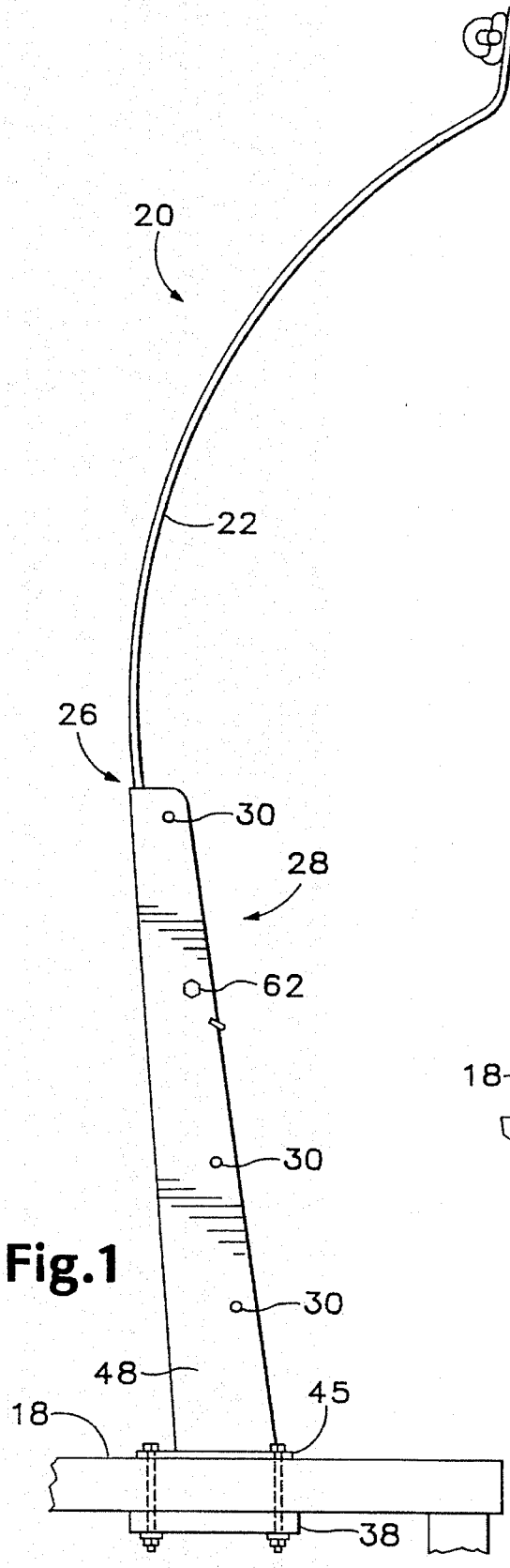
FIG. 1 is a side view of an exemplary non-portable embodiment of the present invention including a base having multiple attachment positions.

An exemplary non-portable embodiment of a mooring device, indicated generally as 20, for connecting a floating object 16 (FIG. 5) to a moorage structure 18 comprises, as shown in FIG. 1, an elongate resiliently yieldable member 22 attached to a base 28 which is adapted for affixing to a moorage structure 18. One end 24 of the yieldable member 22 is preferably adapted to be removably connected to a floating object 16 and the other end 26 of the yieldable member 22 is pivotally attached to the base 28.

Figure 6:
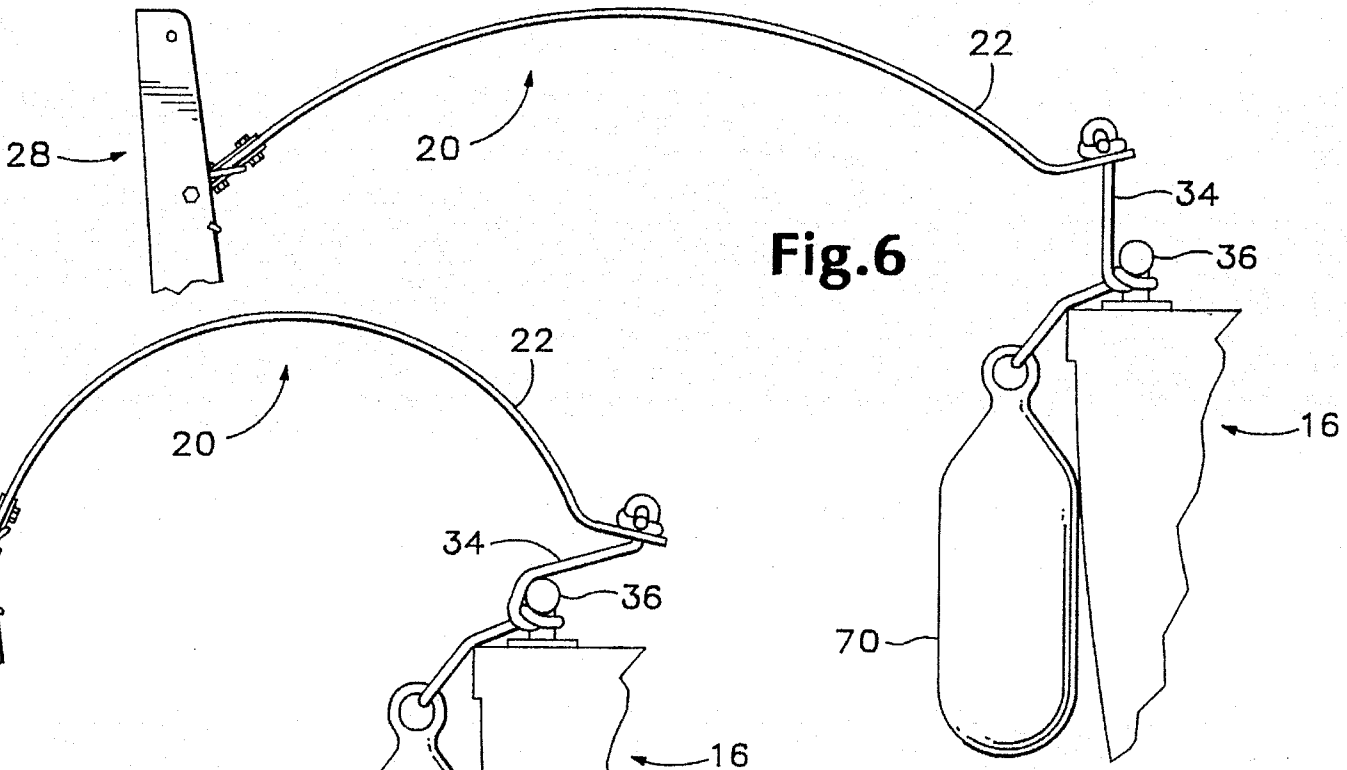
FIG. 6 is a side view of the embodiment of FIG. 1 in an unstressed state.
Figure 7:
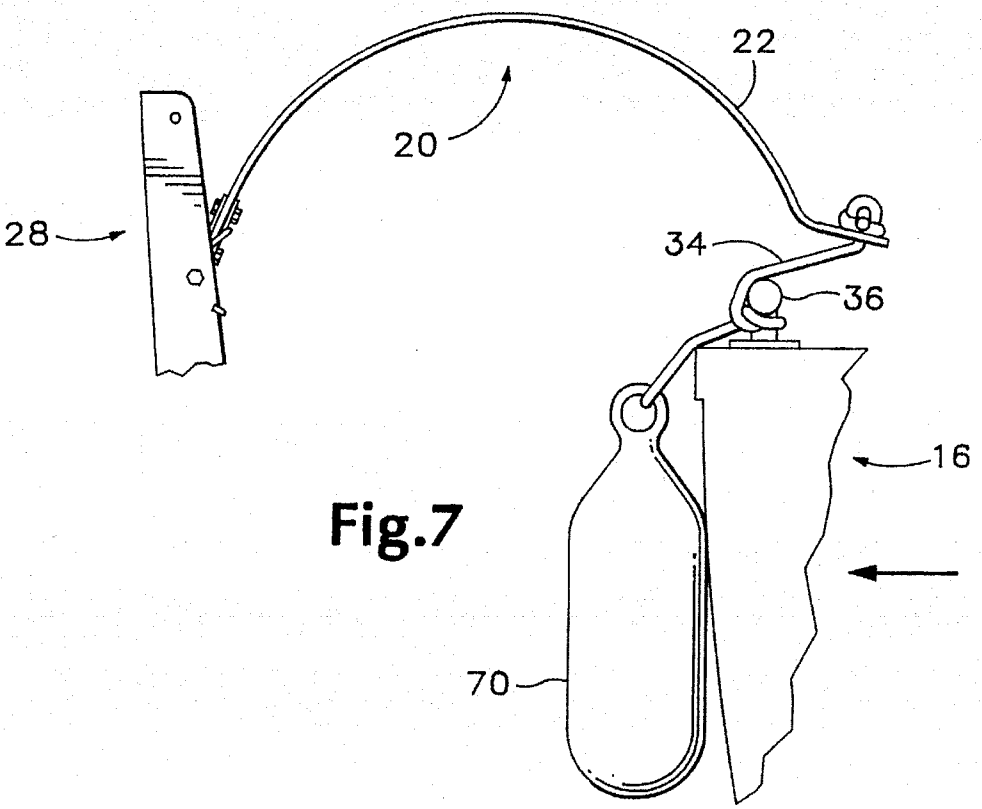
FIG. 7 is a side view of the embodiment of FIG. 1 in a stressed state.

More specifically, FIG. 1 shows an exemplary embodiment of the present invention 20 including an elongate resiliently yieldable member 22 which has a longitudinally-extending, normally arcuate shape when in an unstressed state, as shown also in FIG. 6. The yieldable member 22 is capable of providing an unusually stiff yieldable resistance to movement of the floating object 16 toward the moorage structure 18 by bending from the normally arcuate shape in the unstressed state (FIG. 6) to a slightly more arcuate shape in a stressed state as shown in FIG. 7. The yieldable member 22 in this embodiment may be a fiberglass leaf spring which has an approximate width of 3 inches, an approximate base-to-tip linear dimension of 34 inches, and an approximate average unstressed radius of curvature of 24 inches. The thickness of the member 22 may vary from about 0.30 inch in the areas adjacent its two ends to about 0.35 inch in its central area. It should be noted that other materials such as metals or plastics may be used to form the member 22, and that the dimensions given are meant to be exemplary and could be modified for reasons including the use of different materials and varying sizes of floating object 16.

Figure 3:
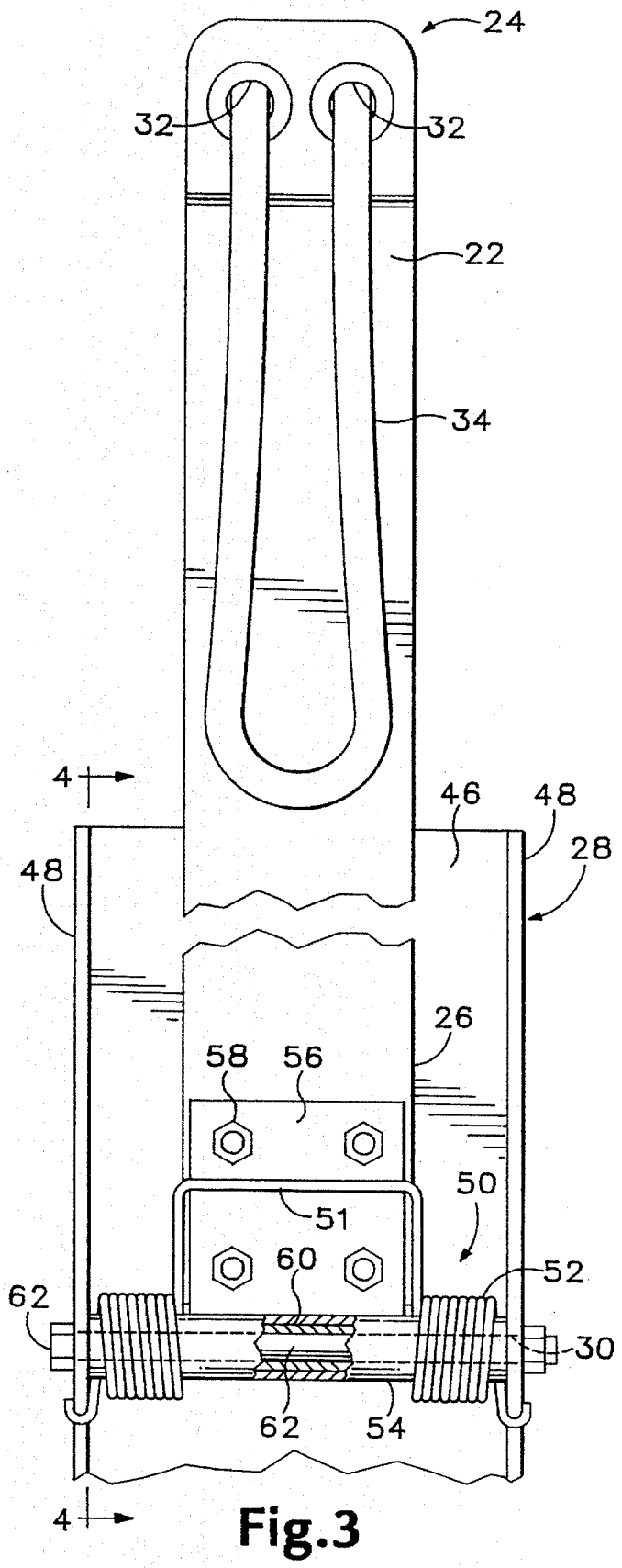
FIG. 3 is a partial front view of the embodiment of FIG. 1.
Figure 5:
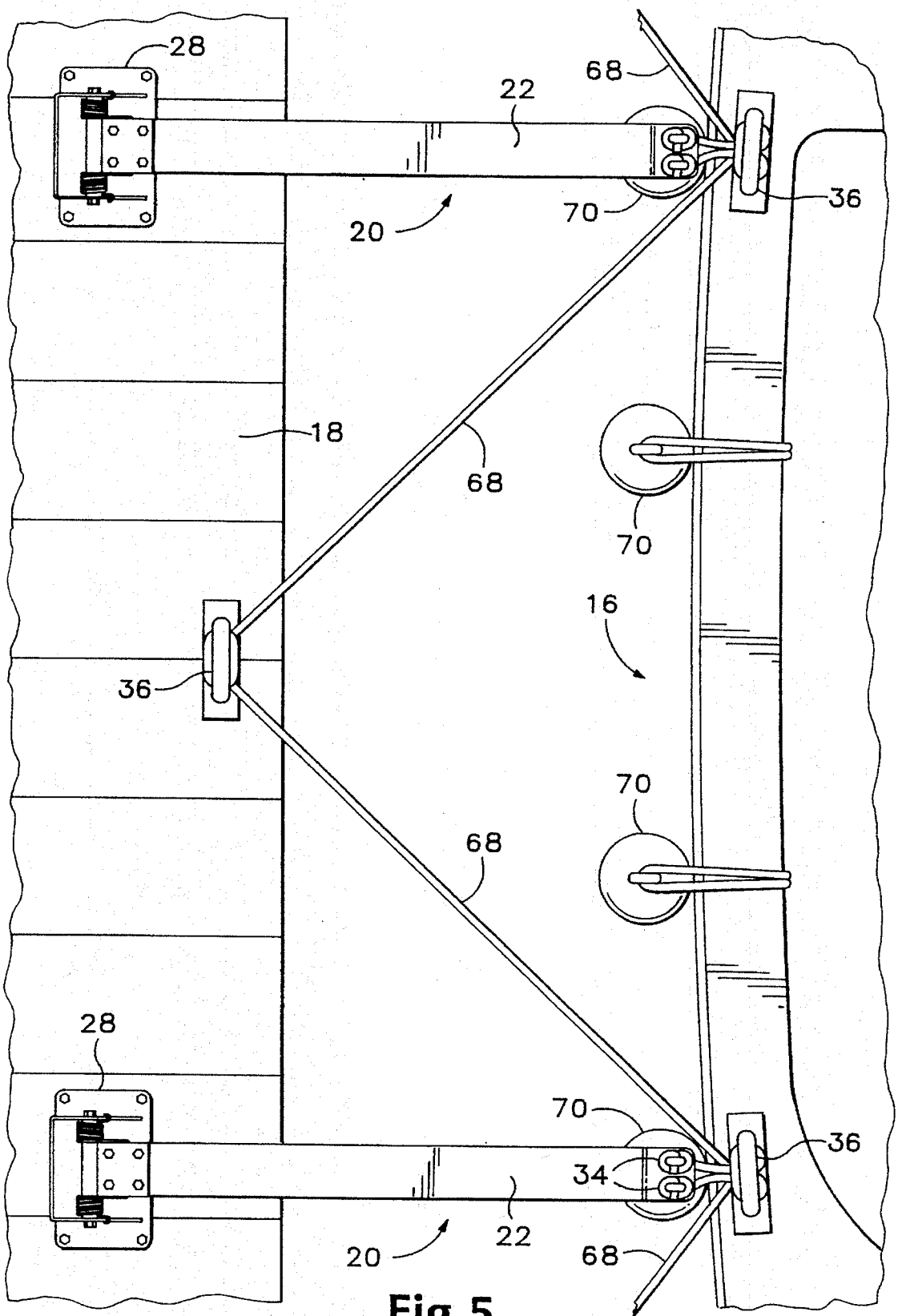
FIG. 5 is a top view showing a pair of mooring devices in accordance with the embodiment of FIG. 1 connecting a floating object to a moorage structure.

Referring again to FIG. 1, the member 22 has an end 24 adapted to be removably connected to the floating object 16. In the preferred embodiment, the end 24 would have two bores 32 defined therein (as shown in FIG. 3) through which a mooring line 34 or rope may be threaded. The ends of the mooring line 34 may be individually knotted, as shown in FIG. 5, or tied together. The effective length of the mooring line 34 may be adjusted by changing the positions of the knots. The loop formed by the mooring line 34 may be attached to a cleat 36 commonly found on floating objects 16 such as boats. Alternate embodiments of the end 24 may also be used, including alternate attachment devices. For example, the end 24 may include a metal hook or clasp which may attach to the cleat 36.

The end 26 of the yieldable member 22 opposite the end 24 is attached to a base 28 which is preferably adapted for affixing to a moorage structure 18. The base 28 may be attached directly to the moorage structure 18 by bolting the base 28 thereto. If desired, a backing plate such as an additional piece of wood or metal 38, which is long enough to span several planks of the moorage structure, can be used for added strength. Another alternate method of attaching the base 28 to the moorage structure 18 would be to through bolt the base 28 to a bull rail 40 (FIG. 2) which is attached to and commonly found on moorage structures 28.

Figure 2:
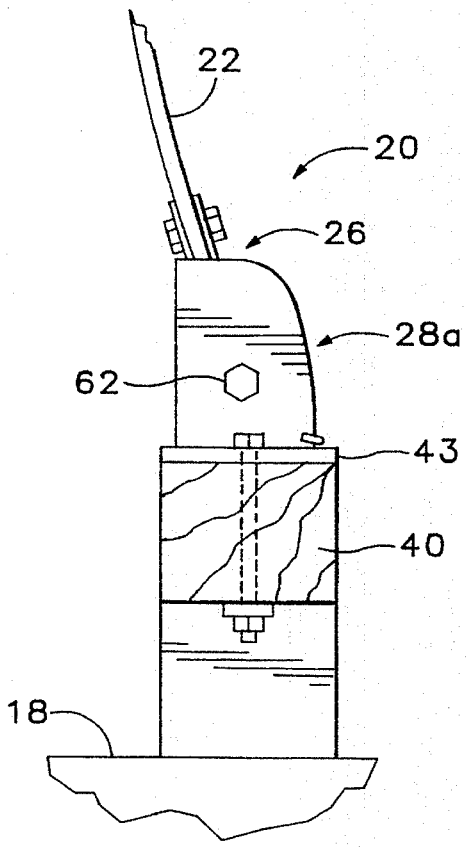
FIG. 2 is a side view of an exemplary non-portable embodiment of a base of the present invention having a single attachment position.
Figure 4:
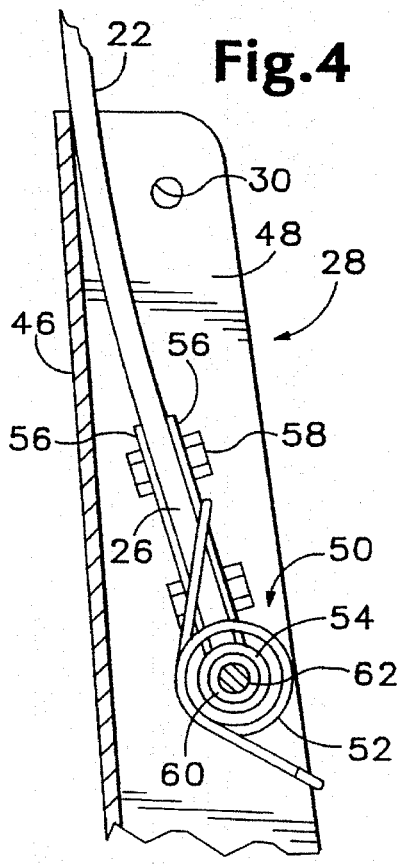
FIG. 4 is a partial sectional side view taken along line 4—4 of FIG. 3.

In the embodiments shown in FIGS. 1 and 2, the bases 28 and **28*a* each have a back such as 46 and two sides such as 48 which are attached along the longitudinal edges of the back 46 as shown with respect to base 28 in FIGS. 3 and 4. The base may be a single height base 28*a*, such as the embodiment shown in FIG. 2, which includes only one attachment position for the end 26 of the leaf spring 22 consisting of a set of bores (not shown) on either side of the base 42 through which a bolt 62 passes. This embodiment is preferably used when the expected difference in height between the mounted end 26 of the member 22 and the cleat 36 on the floating object 16 is small, i.e., no more than approximately 6 inches. The base may alternatively be a multiple height base 28 as shown in FIG. 1 which includes multiple attachment positions at different heights for selective attachment of the end 26 of the yieldable member 22 to the base 28 at different heights approximately equal to the height of the cleat 36 on the particular floating object 16. Each attachment position preferably includes a set of bores 30 on either side of the base 28 through which a bolt 62 may pass. This embodiment is preferably used when the difference in height between the mounted base 28 and the cleat 36 on the floating object 16 will vary, such as when different floating objects 16** are to be accommodated.

FIGS. 3 and 4 show the pivotal attachment of the end 26 of the yieldable member 22 to the base 28 of FIG. 1. The end 26 is pivotally attached to the base 28 by a pivoted biasing device 50 that enables the yieldable member 22 to be pivoted upwardly from the moorage structure 18 with the aid of the biasing device 50 when the end 24 is free of the floating object 16, and pivoted downwardly in opposition to the biasing device 50 to allow the end 24 to connect to the floating object 16 without requiring any bending of the yieldable member 22 from its normally arcuate shape. The pivoted biasing device 50 preferably includes an upwardly-biasing spring 52 such as a return spring which is less resistant to bending than the yieldable member 22 and which enables said member to be pivoted downwardly without bending from its normally arcuate shape while imposing an upward pressure on the end 24. The end 26 is preferably connected to a metal tube or sleeve 54 preferably having a length greater than the width of the yieldable member 22. The end 26 may be connected to the tube 54 using metal plates 56 on either side of the end 26 which are welded to the tube 54 and bolted to the end 26 using bolts 58. An optional bushing 60 may be inserted through the tube 54 to prevent excess wear as the tube pivots about the bolt 62. This configuration allows the spring 52 to tighten as the yieldable member 22 is lowered, thus providing an upward pressure on the end 24 of the yieldable member 22 (as shown in FIGS. 6 and 7). This upward pressure keeps the mooring line 34 from unfastening from the cleat 36 and also keeps the end 24 of the member 22 from striking the cleat on the floating object 16 as the floating object moves toward and away from the moorage structure.

FIG. 5 shows a floating object 16 attached to a moorage structure 18 using mooring devices 20 which include bases 28. Spring lines 68 may be included to keep the floating object 16 from moving forward or aft to relieve undue stress on the mooring devices 20. Additional bumpers or fenders 70 may also be used for extra protection of the floating object 16.

Figure 8:
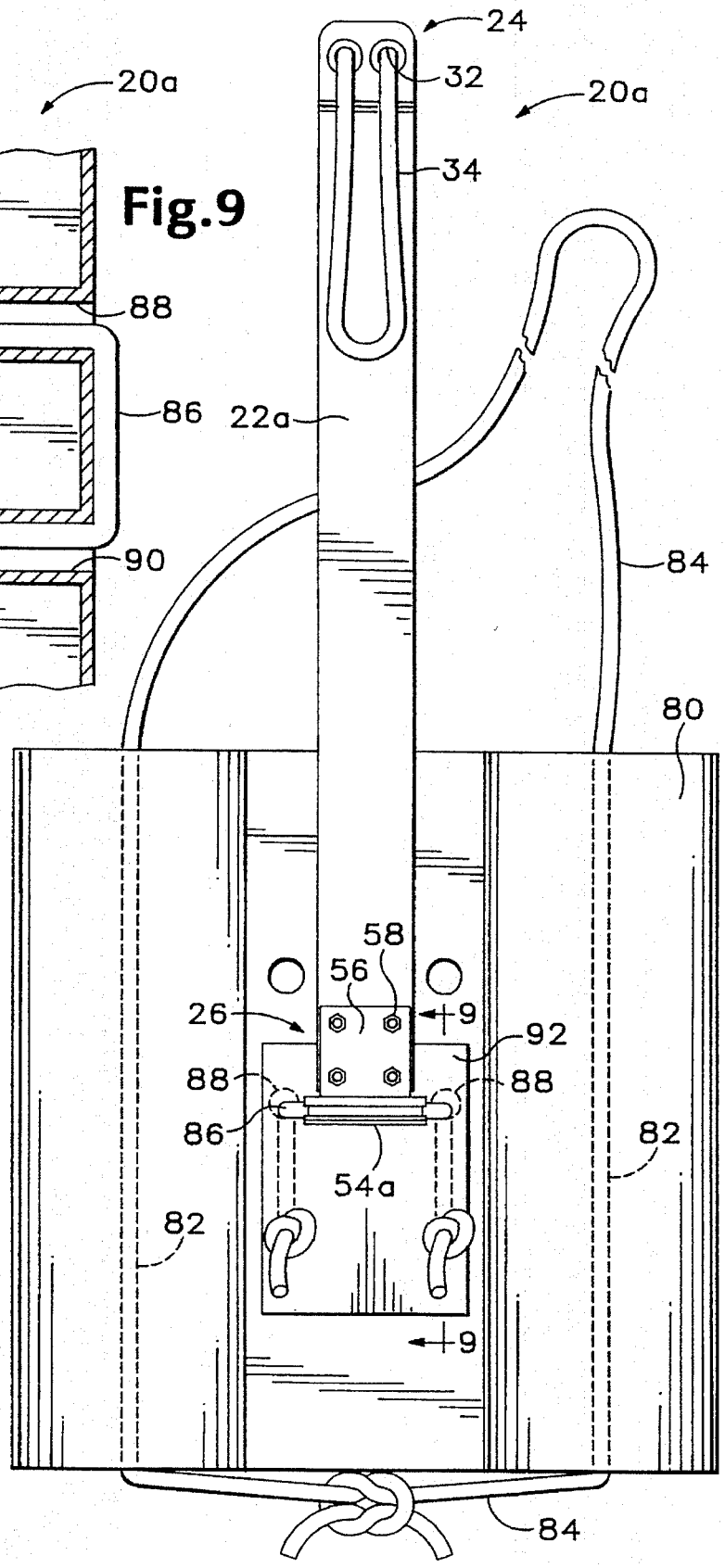
FIG. 8 is a front view of a portable exemplary embodiment of the present invention including a fender for detachably mounting to a floating object.
Figure 10:
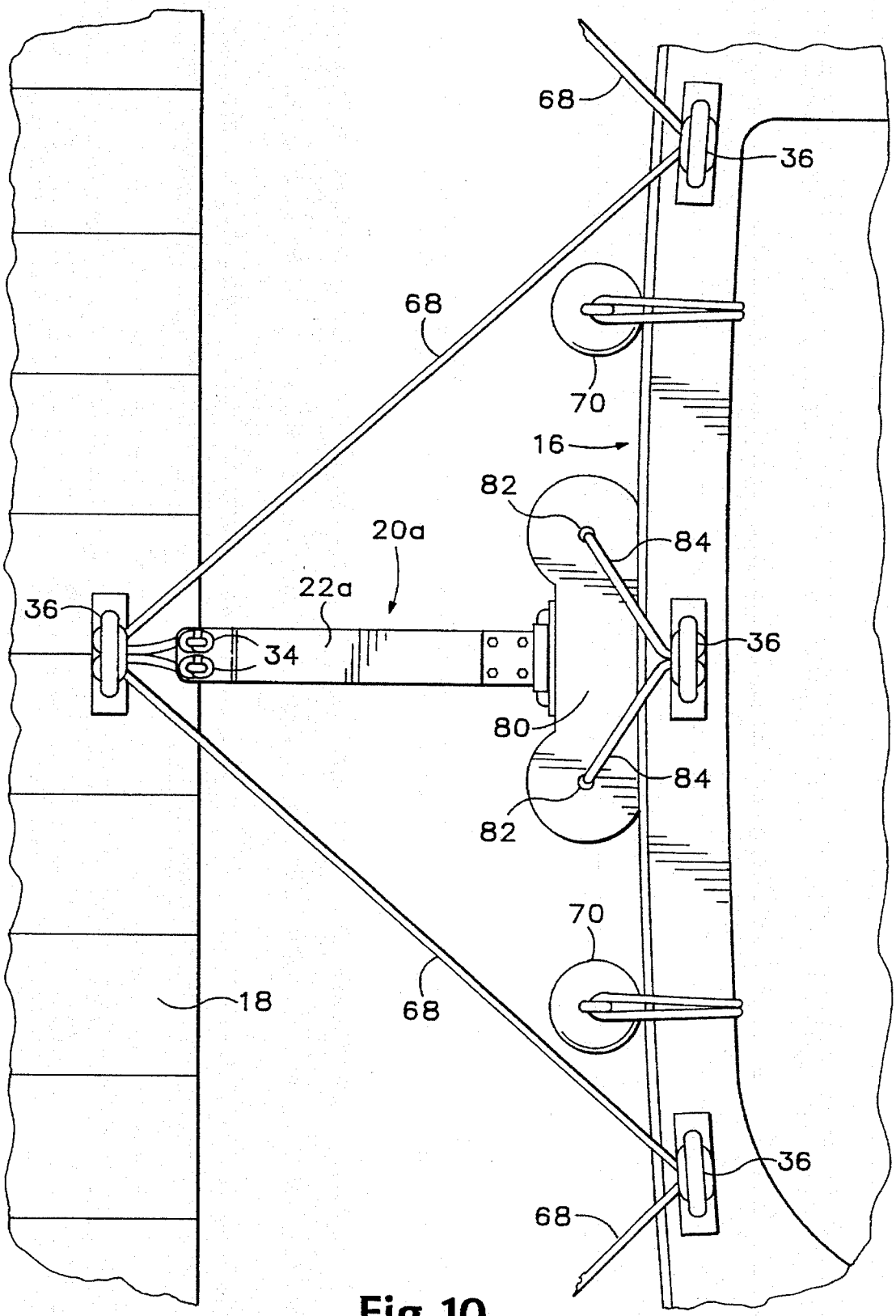
FIG. 10 is a top view of the exemplary embodiment of FIG. 8 shown attached to a floating object using a fender, and connecting the floating object to a moorage structure.
Figure 11:
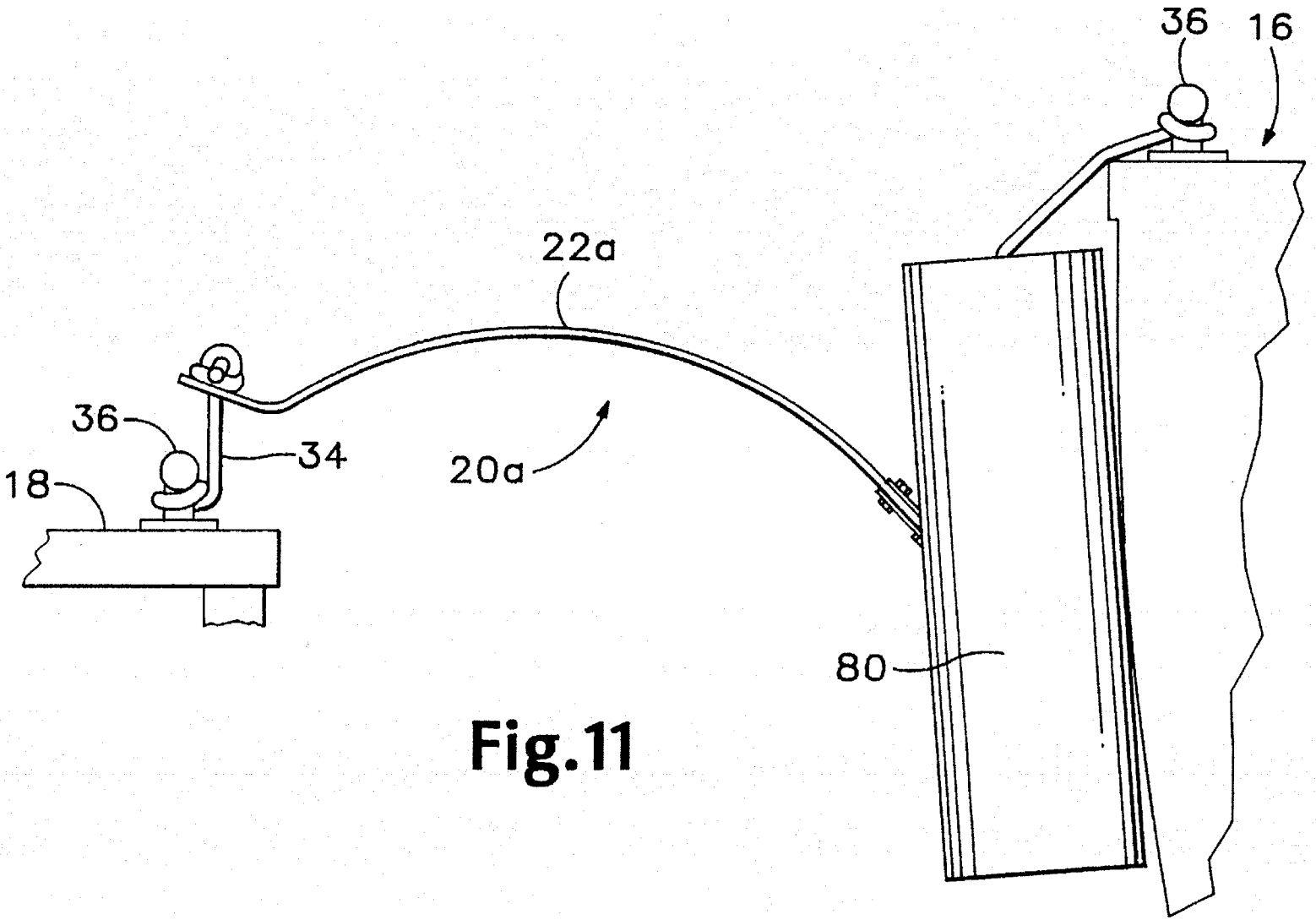
FIG. 11 is a side view of the embodiment of FIG. 8 in an unstressed state.

FIG. 8 shows an alternate exemplary portable embodiment 20*a* of the mooring device including a fender 80, for connecting a floating object 16 (FIG. 10) to a moorage structure 18 (FIG. 10). The alternate embodiment 20*a* comprises, as shown in FIG. 8, an elongate resiliently yieldable member 22*a*, an end 24 adapted to be removably connected to the moorage structure 18, and an end 26 attached to a fender 80 which is adapted to be removably attached to the floating object 16. Like the embodiment discussed above, the elongate resiliently yieldable member 22*a* has a longitudinally-extending, normally arcuate shape when in an unstressed state (FIG. 11). The yieldable member 22*a* functions like the previously described member 22 to provide yieldable resistance to movement of the floating object 16 toward the moorage structure 18, and may be a fiberglass leaf spring having the same dimensions as member 22. Preferably, however, the member 22*a* is somewhat shorter and thinner than the member 22, having an approximate linear base-to-tip dimension of 28 inches, an end thickness of about 0.24 inch, and a central thickness of about 0.27 inch. The radius of curvature and width are approximately the same as described previously.

The fender 80 may be made of any resilient, water-impermeable material such as a flexible plastic, rubber, or closed-cell foam, and is preferably of the type shown in U.S. Pat. No. 5,013,272 which is hereby incorporated by reference. Alternatively, other structures such as a bracket which may be removably secured to the floating object 16 could be used to attach the yieldable member 22*a* to the floating object and prevent the end 26 from coming in contact with and damaging the floating object 16.

Referring again to FIG. 8, the alternate portable embodiment 20*a* of the mooring device has an end 24 with a mooring line 34 similar to that of the previous embodiment 20 but, in this case, adapted to be removably connected to the moorage structure 18 rather than the floating object 16. The end 26 opposite the end 24 is attached to the fender 80 which is adapted to be removably attached to the floating object 16 at different heights so that the end 26 of the member 22*a* is at approximately the same height as a cleat 36 on the moorage structure.

The resilient fender 80 has two longitudinal channels 82 through which a mooring line 84 or rope may be threaded. The ends of the mooring line 84 may be tied together as shown in FIG. 8 or individually knotted. The mooring line 84 is length-adjustable by adjustment of the knot or knots to change the height of the fender 80. The center section of the mooring line 84 forms a loop which may be attached to a cleat 36 commonly found on floating objects 16 such as boats (FIG. 10).

Figure 9:
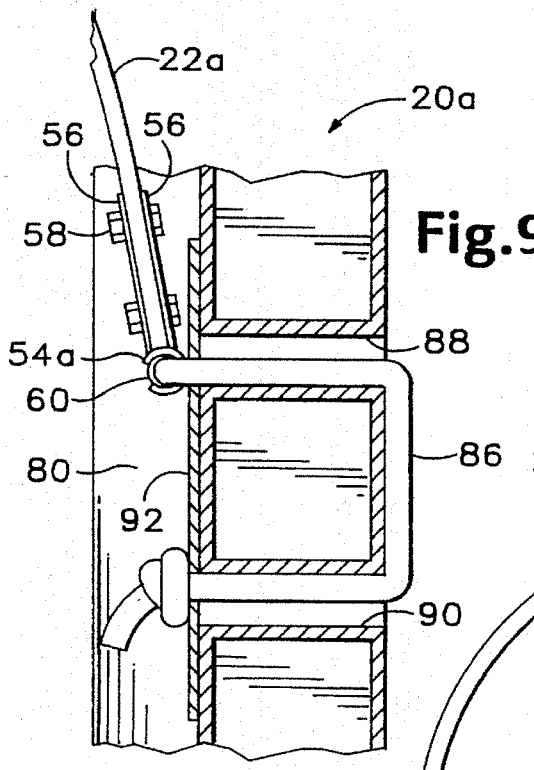
FIG. 9 is a partial sectional view taken along line 9—9 of FIG. 8.

FIGS. 8 and 9 show the attachment of the end 26 of the yieldable member 22*a* to the fender 80. The end 26 has a metal tube or sleeve 54*a* similar to tube 54 of the previous embodiment. An optional bushing 60 may be inserted through the tube 54*a* to prevent excess wear and chafing of a rope 86 which is used to pivotally connect the end 26 to the fender 80. As best seen in FIG. 9, the center portion of the rope 86 is threaded through the tube 54*a* and the bushing 60, and then through a first set of channels 88 which extend through the thickness of the fender 80. The rope 86 then wraps around the back of the fender 80 and threads back through a second set of channels 90. The ends of the mooring line 86 may be individually knotted or may be tied together. Additional reinforcement 92 such as a plastic or metal plate may be added to the fender 80 to prevent the fender 80 from tearing or abrading.

An additional feature which may be included in the portable embodiment 20*a* is that the yieldable member 22*a* may be detachable from the fender 80 for easy storage on the floating object 16. This feature, as shown in FIG. 9, comprises a slot 55 having the width of the rope 86 cut along the entire length of the tube 54*a*. The slot is located approximately 90° from the end 26 of the yieldable member 22*a* on the concave side of the member 22*a*. For detachment from the rope 86, the member 22*a* may be rotated approximately 180° downward so that the slot 55 faces the fender and is aligned with the rope 86. The tube 54*a* may then be slid off the rope 86, and the fender 80 and member 22*a* can be stored separately.

FIG. 10 shows a floating object 16 attached to a moorage structure 18 using the portable alternate embodiment 20*a* of the mooring device. Spring lines 68 may be included to keep the floating object 16 from moving forward or aft to relieve undue stress from the mooring device 20*a*. Additional bumpers or fenders 70 may also be used for extra protection of the floating object 16.

It should be noted that the first exemplary embodiment could be adapted so that the base 28 attaches directly to a floating object 16 and the end 24 of the yieldable member 22 could then attach to a cleat 36 on a moorage structure 18. It should also be noted that, in the alternate portable exemplary embodiment, the fender 80 could be adapted to be attached to a cleat 36 on a moorage structure 18 and the end 24 of the yieldable member 22*a* could attached to a cleat 36 on a floating object 16.

Figure 12:
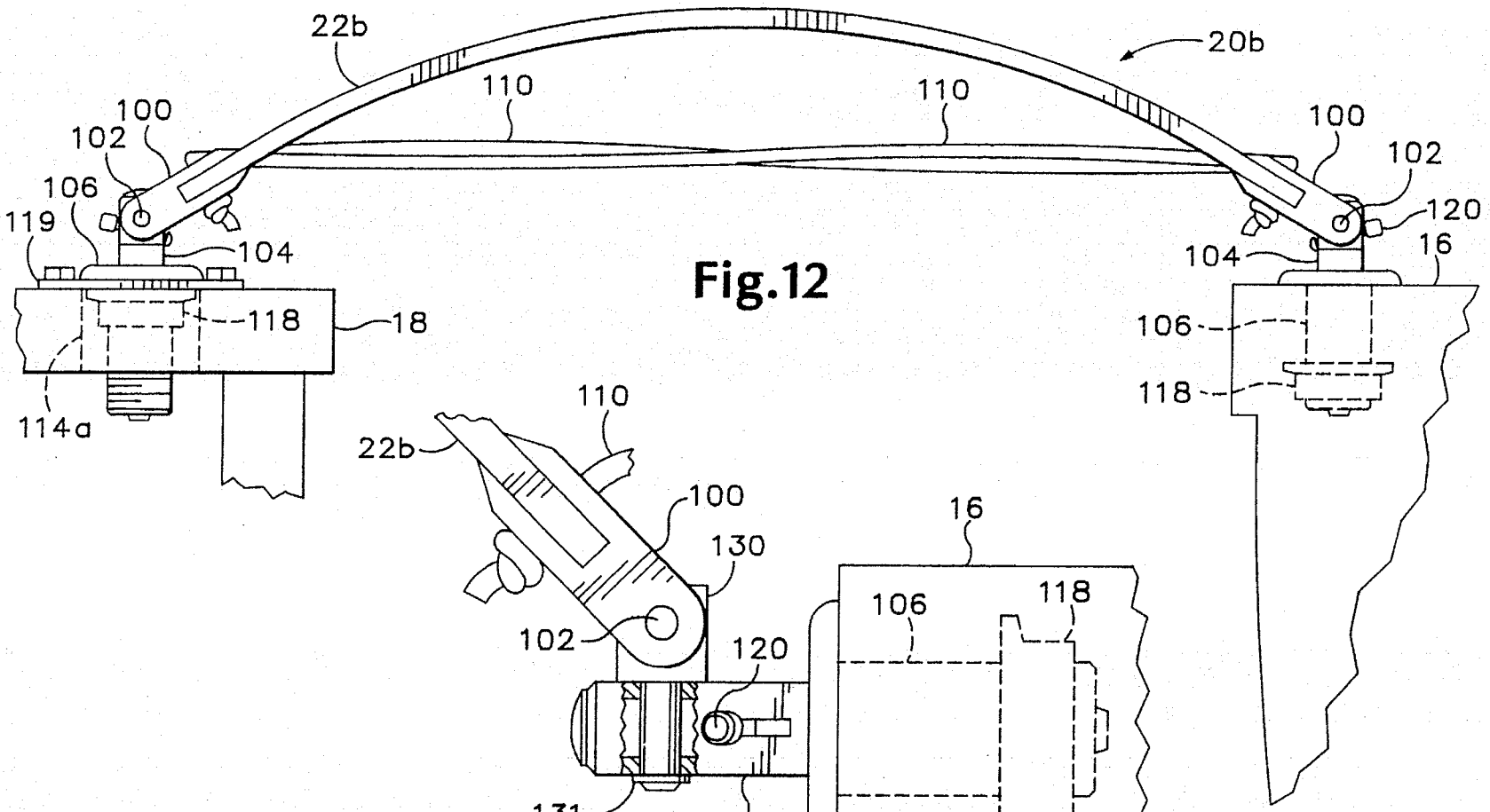
FIG. 12 is a side view of a further exemplary embodiment of the present invention which is especially easy to attach and detach and which is usable selectively either portably or non-portably.

FIG. 12 shows a further alternate exemplary embodiment 20*b* of the mooring device comprising an elongate resiliently yieldable member 22*b* connecting a floating object 16 to a moorage structure 18. The mooring device 20*b* is especially easy to attach and detach, may be used either portably or nonportably, and does not require the presence of cleats either on the floating object 16 or on the moorage structure 18. (However, if desired, a loop of mooring line or other suitable attachment device may optionally be provided on either end of the member 22*b* for attachment to a cleat.)

Like the previous embodiments, the elongate resiliently yieldable member 22*b* has a longitudinally-extending normally arcuate shape when in an unstressed state, and functions to provide yieldable resistance to movement of the floating object 16 toward the moorage structure 18. The member 22*b* is preferably a fiberglass leaf spring having a higher volumetric percentage of glass fibers (about 65%) than the previous embodiments (about 50%), and thus is stiffer. Therefore its width can be about 1.75 inches and its thickness about 0.25 inches, with a linear length of about 32 inches and a radius of curvature similar to that of the previous embodiments. Each end of member 22*b* has a respective clevis 100 rigidly affixed thereto, each clevis 100 having a respective horizontal clevis pin 102 to which is pivotally attached a respective connection pin 104. Each connection pin 104 is slidably insertable detachably into a respective socket 106 mounted within the respective floating object 16 or moorage structure 18, in a manner to be described hereafter. Each pin 104 is also pivotable about its vertical axis with respect to its socket 106 so that each end of the member 22*b* pivots with respect to the floating object 16 or moorage structure 18 about a respective pair of mutually perpendicular axes, one generally horizontal and the other generally vertical, and both generally transverse to the member 22*b*. The horizontal axis of each clevis pin 102 provides pivoting to isolate the socket 106 from torques imposed by toward-and-away motions and vertical motions of the floating object 16 relative to the moorage structure 18, while the vertical axis of rotation of each pin 104 isolates the socket 106 from torques due to horizontal motions of the floating object 16 parallel to the moorage structure 18.

Figure 15:
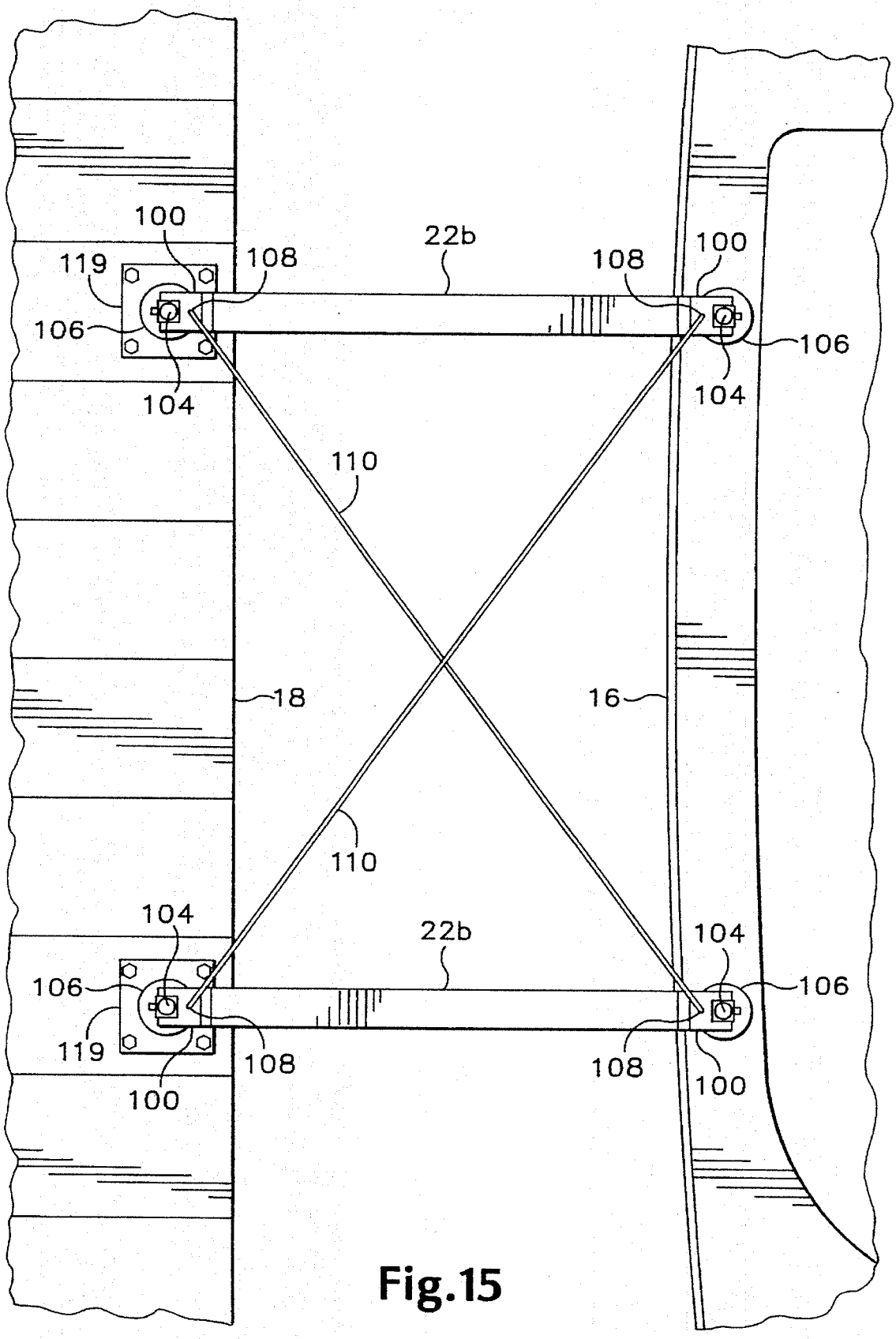
FIG. 15 is a plan view showing the embodiment of FIG. 12 in use.

Each clevis 100 contains a respective aperture 108 formed therein for fastening a respective spring line 110 thereto, as shown in FIG. 15, so that the spring lines 110 are automatically attached and detached from the floating object 16 or moorage structure 18 in unison with the member 22*b*.

Figure 13:
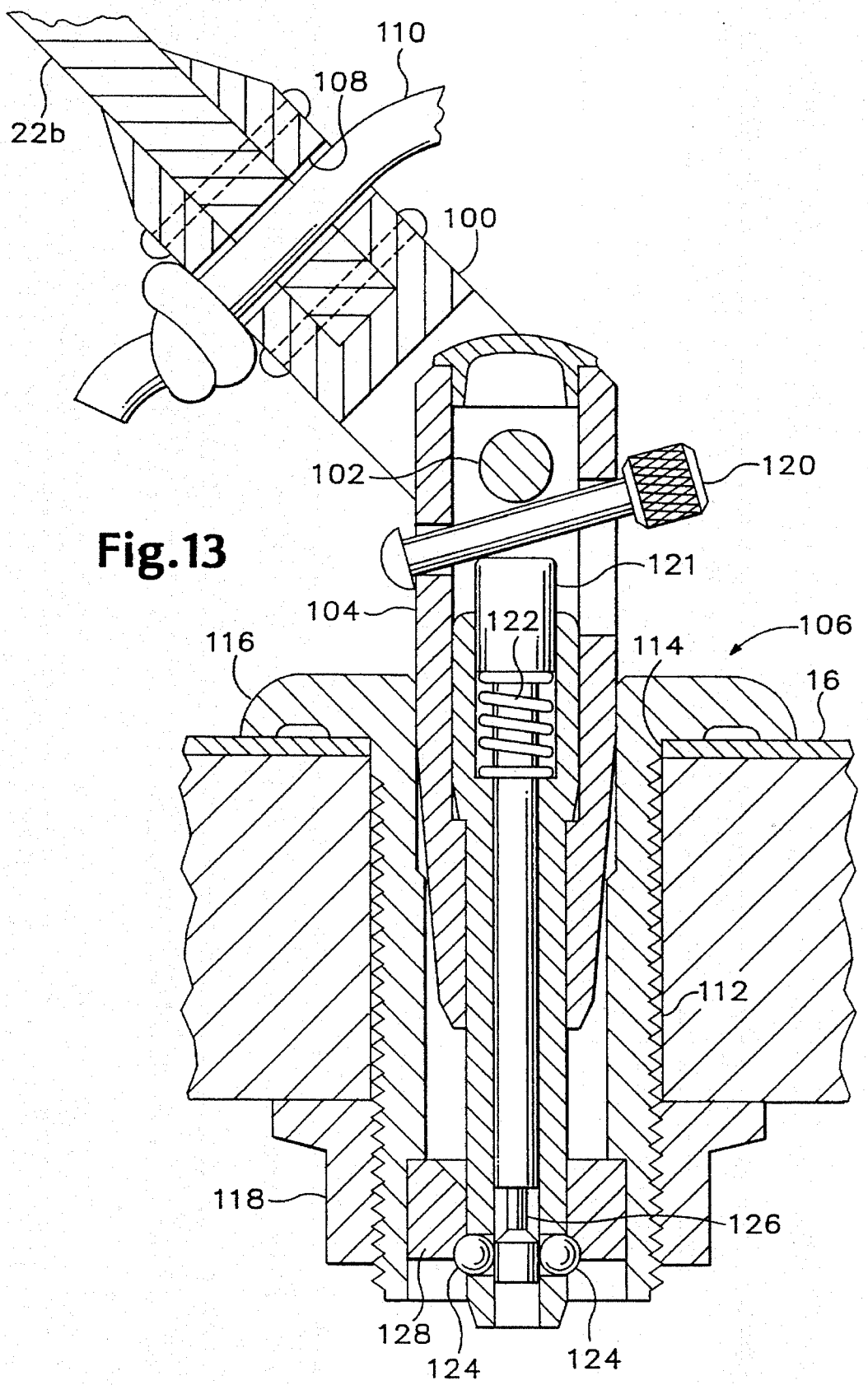
FIG. 13 is a cross-sectional view of the detachable interconnecting structure used in FIG. 12.

With reference to FIG. 13, each socket 106 comprises an externally threaded socket member 112 insertable through an aperture 114 which the user cuts through the exterior surface of the floating object 16 and/or moorage structure 18. The socket 106 has an exterior flange 116, from the underside of which a nut 118 may be tightened to clamp the socket 106 in place within the aperture 114. Depending upon the application and the need for water-tightness, appropriate caulking or a resilient gasket may be placed on the underside of the flange 116 to form a liquid-impervious seal.

With reference to FIG. 12, for mounting the socket 106 within a moorage structure 18, a larger aperture 114*a* may be drilled with a sufficient diameter to accept the insertion of the nut 118. The socket 106 is fastened by means of the nut 118 to a steel plate which is then bolted to the moorage structure 18, with the nut 118 recessed within the aperture 114*a*. This eliminates the need to apply the nut 118 from within the moorage structure, which could otherwise be difficult or impossible.

The pin 104 is slidably and rotatably insertable into the socket 106 by inserting the pin 104 while pressing downwardly on a lever 120, thereby depressing a plunger 121 against a spring 122 and enabling locking elements 124 to move inwardly into an annular groove 126 on the plunger 121 and thereby slide through an annular locking member 128 fixed to the inside of the socket member 112. Release of the lever 120 forces the locking elements 124 outwardly and prevents their withdrawal through the locking member 128 until the user once more depresses the lever 120 and withdraws the pin 104 from the socket 106.

Figure 14:
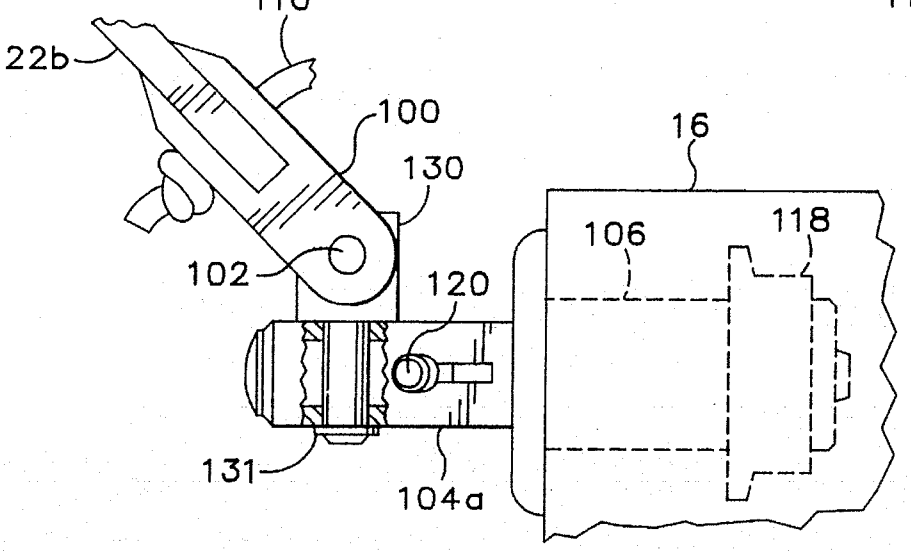
FIG. 14 is a partial side view of an alternative detachable interconnecting structure which may be used in the embodiment of FIG. 12.

If it is necessary to mount a socket 106 within a substantially vertical surface on the floating object 16 or moorage structure 18 in order to achieve a substantially equal height relationship between the two sockets 106, the respective socket 106 may be mounted within such a vertical surface in the same manner as previously described with respect to FIGS. 12 and 13. In such case it is desirable to employ an alternate connection pin 104*a* (FIG. 14) which, although otherwise identical to connection pin 104 described previously, does not connect directly to clevis pin 102 but rather connects thereto through a post 130 which mounts perpendicular to the pin 104*a* and rotates axially with respect thereto while retained by a snap ring 131. Such axial rotation of the post 130 provides the vertical-axis pivoting described previously which isolates the socket 106 from torques due to horizontal motions of the floating object 16 parallel to the moorage structure 18. The use of vertical attachment surfaces at both ends of a member 22*b* should be avoided because the three axes of rotation allowed by pins 104*a*, if present at both ends, would allow member 22*b* to rotate longitudinally.

In use, a pair of the members 22*b* are attached to the top horizontal surface or the front vertical surface of a moorage structure 18 using sockets 106 and pins 104 or 104*a*, and interconnected by spring lines 110 attached to apertures 108 in the respective clevises 100 as shown in FIG. 15. Similar sockets 106 are attached to horizontal or vertical attachment surfaces of a floating object 16 at approximately the same level and horizontal spacing as the sockets 106 on the moorage structure. The members 22*b* are detachably connected to the floating object 16 by means of pins 104 or 104*a*.

Detachment of the floating object from the moorage structure can be accomplished quickly simply by detaching the pins 104 or 104*a* from the sockets 106 on the floating object by depression of the levers 120. If it is desired to transport the members 22*b* portably with the floating object 16, they are detached at both ends and stowed, with their spring lines attached, in the floating object for later attachment to another moorage structure or another floating object having sockets 106 of matching spacing and height.

Alternatively, only a single member 22*b* could be attachable to a floating object by a socket 106 installed midway between the bow and stern. In such case the member 22*b* could be carried portably for attachment to an ordinary cleat on a moorage structure using a loop of mooring line or other cleat-attaching device in the same manner as shown in FIG. 10.

It should be noted that the various embodiments may be used independently and do not necessarily need mooring lines and fenders. Also, since the mooring device is intended to be used near water in varying climates, the materials used to construct the mooring device are preferably weather resistant and otherwise sturdy.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A mooring device for connecting a floating object to a moorage structure, said mooring device comprising:

(a) an elongate resiliently yieldable member having two ends and a longitudinally-extending, normally arcuate shape when in an unstressed state;

(b) said ends being adapted to be connected to said floating object and to said moorage structure, respectively, so as to yieldably resist movement of said floating object toward said moorage structure by bending from said normally arcuate shape to a more arcuate shape in response to said movement;

(c) at least one of said ends being pivotally attached to a pin so as to pivot with respect to said pin about an axis substantially transverse to said elongate resiliently yieldable member; and (d) a socket mountable within at least one of said floating object and moorage structure in communication with an exterior surface thereof, said pin being slidably insertable into said socket through said exterior surface and detachably lockable therein so as to fasten said pin within said one of said floating object and moorage structure.

2. The mooring device of claim 1 wherein said pin is axially rotatable relative to said socket.

3. The mooring device of claim 1 wherein said one of said ends is pivotally attached to said pin so as to pivot with respect thereto about a pair of mutually perpendicular axes both of which are substantially transverse to said member.

4. The mooring device of claim 1 including a respective said pin and socket associated with each of said ends of said member.

5. The mooring device of claim 1 wherein said resiliently yieldable member has a generally elongate cross-section with a breadth substantially greater than its thickness.

6. A mooring device for connecting a floating object to a moorage structure, said mooring device comprising:

(a) an elongate resiliently yieldable member having two ends and a longitudinally-extending, normally arcuate shape when in an unstressed state;

(b) said ends being adapted to be connected to said floating object and to said moorage structure, respectively, so as to yieldably resist movement of said floating object toward said moorage structure by bending from said normally arcuate shape to a more arcuate shape in response to said movement;

(c) said ends being pivotally attachable to said floating object and to said moorage structure, respectively, so that each of said ends pivots with respect thereto about a respective substantially horizontal axis and a substantially vertical axis, both of which are substantially transverse to said member.

7. The mooring device of claim 6 wherein at least one of said ends is pivotally attachable within an exterior surface of said floating object.

8. The mooring device of claim 6 wherein said resiliently yieldable member has a generally elongate cross-section with a breath substantially greater than its thickness.

9. A mooring device for connecting a floating object to a moorage structure, said mooring device comprising:

(a) an elongate resiliently yieldable member having two ends and a longitudinally-extending, normally arcuate shape when in an unstressed state:

(b) said ends being adapted to be connected to said floating object and to said moorage structure, respectively, so as to yieldably resist movement of said floating object toward said moorage structure by bending from said normally arcuate shape to a more arcuate shape in response to said movement;

(c) said ends having respective spring lines fastened thereto and being detachable from said floating object and said moorage structure, respectively, in unison with said respective spring lines.

10. The mooring device of claim 9 wherein said resiliently yieldable member has a generally elongate cross-section with a breadth substantially greater than its thickness.

* * * * *